US009809285B1

(12) United States Patent
Yeh

(10) Patent No.: US 9,809,285 B1
(45) Date of Patent: Nov. 7, 2017

(54) WATERSPORT BOARD

(71) Applicant: AGIT Global IP Holdings, LLC, Irvine, CA (US)

(72) Inventor: Tzong In Yeh, Fremont, CA (US)

(73) Assignee: Agit Global IP Holdings, LLC, Irvine, CA (US)

( * ) Notice: Subject to any disclaimer, the term of this patent is extended or adjusted under 35 U.S.C. 154(b) by 0 days.

(21) Appl. No.: 15/266,173

(22) Filed: Sep. 15, 2016

(51) Int. Cl.
*B63B 35/79* (2006.01)

(52) U.S. Cl.
CPC ..... *B63B 35/7926* (2013.01); *B63B 35/793* (2013.01); *B63B 35/7909* (2013.01)

(58) Field of Classification Search
CPC ..... B63B 35/7926
USPC ..... 441/74
See application file for complete search history.

(56) References Cited

U.S. PATENT DOCUMENTS 6,991,503 B2 * 1/2006 Garcia ..... B63B 35/793 441/79
7,108,571 B2 * 9/2006 Geraghty ..... B63B 35/793 114/39.15
7,497,752 B2 * 3/2009 Field ..... B63B 35/793 114/127
8,465,334 B2 * 6/2013 Hort ..... B63B 35/793 441/79
8,764,502 B2 * 7/2014 McCredie ..... B63B 35/793 441/79
2004/0035346 A1 * 2/2004 Davey ..... B63B 35/793 114/152
2008/0311807 A1 * 12/2008 Luke ..... B63B 35/7926 441/79
2012/0279436 A1 * 11/2012 Wood ..... B63B 35/793 114/343
2013/0189886 A1 * 7/2013 Yeh ..... B63B 35/793 441/79

* cited by examiner

*Primary Examiner* — Lars A Olson
*Assistant Examiner* — Jovon Hayes
(74) *Attorney, Agent, or Firm* — Muncy, Geissler, Olds & Lowe, P.C.

(57) ABSTRACT

A watersport board includes a board body, two female fasteners, a baseplate, a fin adapter, a fin and two male fasteners. The board body defines a receptacle. The female fasteners are embedded in the board body. Each female fastener has a receiving hole. The baseplate is attached underneath the board body. The baseplate has a first bore and two second bores. The fin adapter has an adapter body and an extension laterally extending from the adapter body. The adapter body passes through the first bore of the baseplate and is engaged in the receptacle of the board body, and the adapter body has a cavity. The fin has a base portion received in the cavity of the adapter body. Each male fastener has one end connected to the extension of the fin adapter, and the other end passing through the second bore of the baseplate and being engaged in the receiving hole of the female fastener.

9 Claims, 9 Drawing Sheets

WATERSPORT BOARD

BACKGROUND OF THE INVENTION

1. Field of the Invention

The present invention relates to a watersport board, and more particularly to a watersport board with a fin.

2. Description of the Related Art

A watersport board, such as surfboard or sailboard, is generally equipped with a fin at the tail thereof to improve directional stability and control through foot-steering, allowing the surfer to control direction by varying their side-to-side weight distribution. It has also been long recognized that the fin and fin box region of the board play a significant part in the board's ability to perform in the water. For example, all the power of the wind harnessed by the sail must be transmitted through the fin in order to propel the sailboard along the water in the desired direction. Accordingly, there have been a number of attempts to solve the problems particular to fins and their fin boxes.

One type of watersport board is illustrated in FIG. 9, in which the watersport board generally includes a board body 91, a fin assembly 92, a fastener 93 and a soft plate 94. The board body 91 defines a hole 910 in the tail thereof. The fin assembly 92 includes a fin adapter 921 and a fin body 922. A locking groove 923 is defined in a top surface of the fin adapter 921. A slot 924 is defined in a bottom surface of the fin adapter 921 to receive the fin body 922. The fin adapter 921 is engaged in a lower space of the hole 910 of the board body 91. The fastener 93 is inserted in an upper space of the hole 910 of the board body 91 and engaged in the locking groove 923 of the fin adapter 921. The soft plate 94 is provided to cover the top surface of the board body 91.

SUMMARY OF THE INVENTION

The present invention provides a new watersport board, which generally includes a board body, a plurality of female fasteners, a baseplate, a fin adapter, a fin and a plurality of male fasteners.

Specifically, the board body defines a receptacle in a bottom surface. The female fasteners are embedded in the bottom surface of the board body. And each of the female fasteners has a receiving hole exposed to outside of the board body. The baseplate is attached to the bottom surface of the board body. Moreover, the baseplate has a first bore in line with the receptacle of the board body and a plurality of second bores in line with the respective receiving holes of the female fasteners. The fin adapter has an adapter body and an extension laterally extending from a lower edge of the adapter body. The adapter body passes through the first bore of the baseplate and is engaged in the receptacle of the board body, and the adapter body has a cavity defined in a bottom surface thereof. The fin has a base portion received in the cavity of the adapter body of the fin adapter. Each of the male fasteners has one end connected to the extension of the fin adapter, and the other end passing through the second bore of the baseplate and being engaged in the respective receiving hole of the female fastener so as to secure the fin adapter in the receptacle of the board body.

The foregoing and other objectives, features, and advantages of the invention will be more readily understood upon consideration of the following detailed description of the invention, taken in conjunction with the accompanying drawings.

DETAILED DESCRIPTION OF EMBODIMENTS

Figure 1:
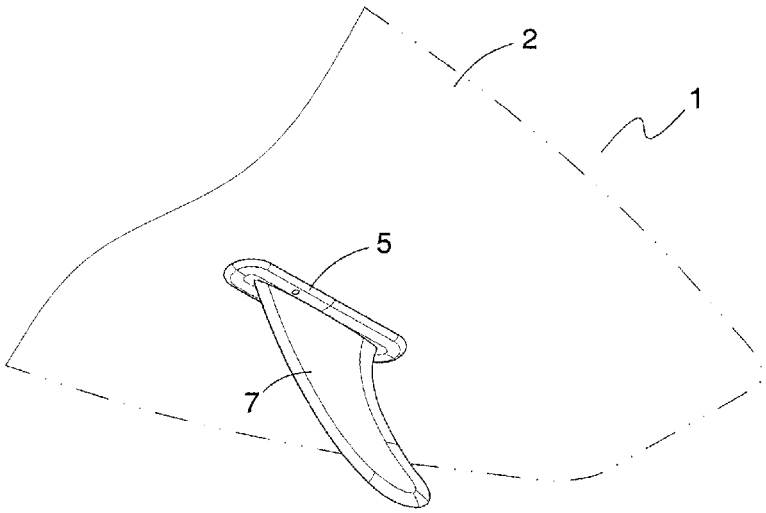
FIG. 1 is a perspective view of a watersport board in accordance with one embodiment of the present invention.

Referring to FIGS. 1 through 6, there is shown one embodiment of the watersport board 1, which generally includes a board body 2, a base plate 4 bonded to a bottom surface 211, 222 of the board body 2, and a fin assembly (not numbered) joined to the board body 2 and the baseplate 4. The fin assembly includes two female fasteners 3, a fin adapter 5 and two male fasteners 6 and a fin 7.

Figure 2:
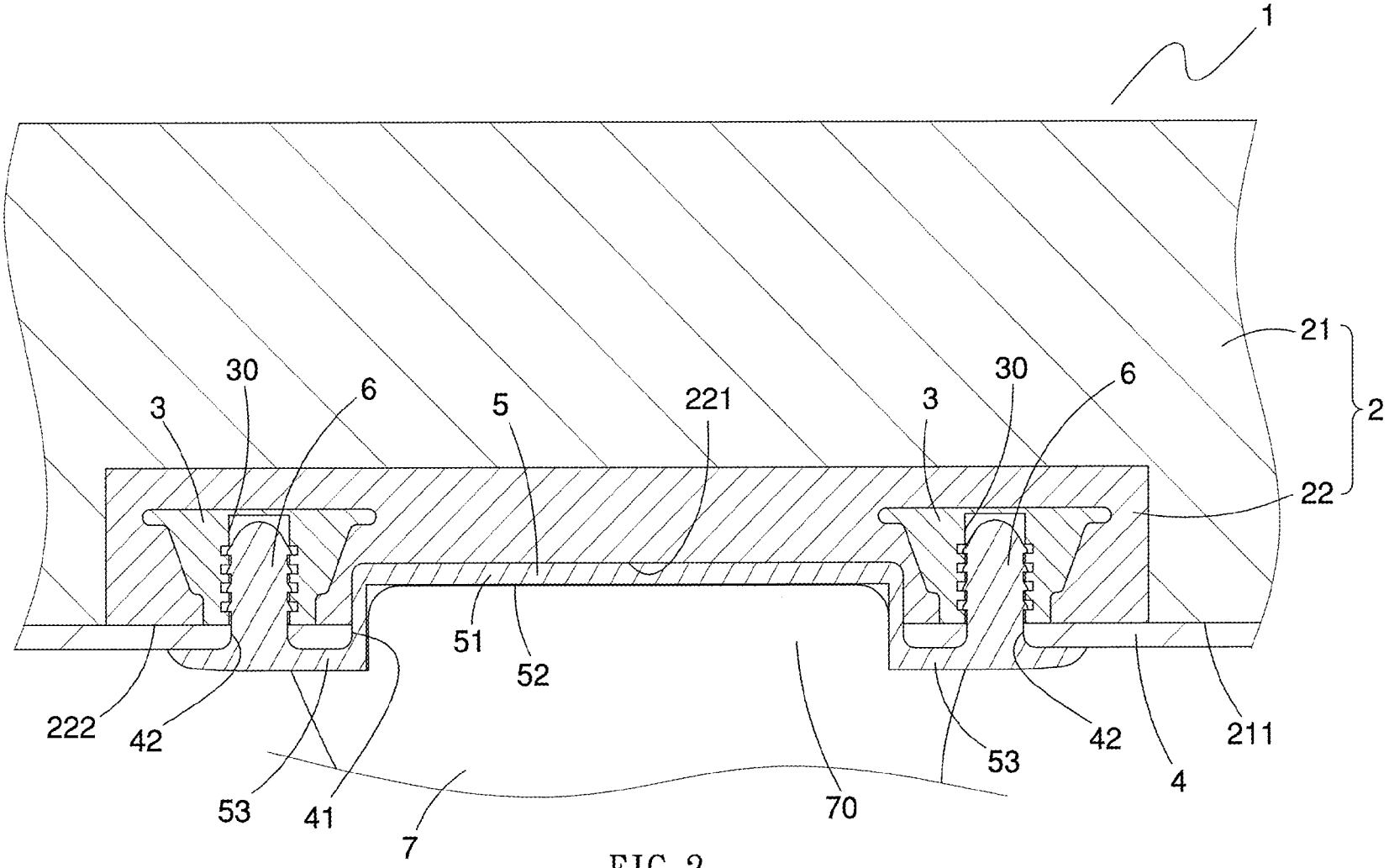
FIG. 2 is a partial cross-sectional view of the watersport board shown in FIG. 1.
Figure 3:
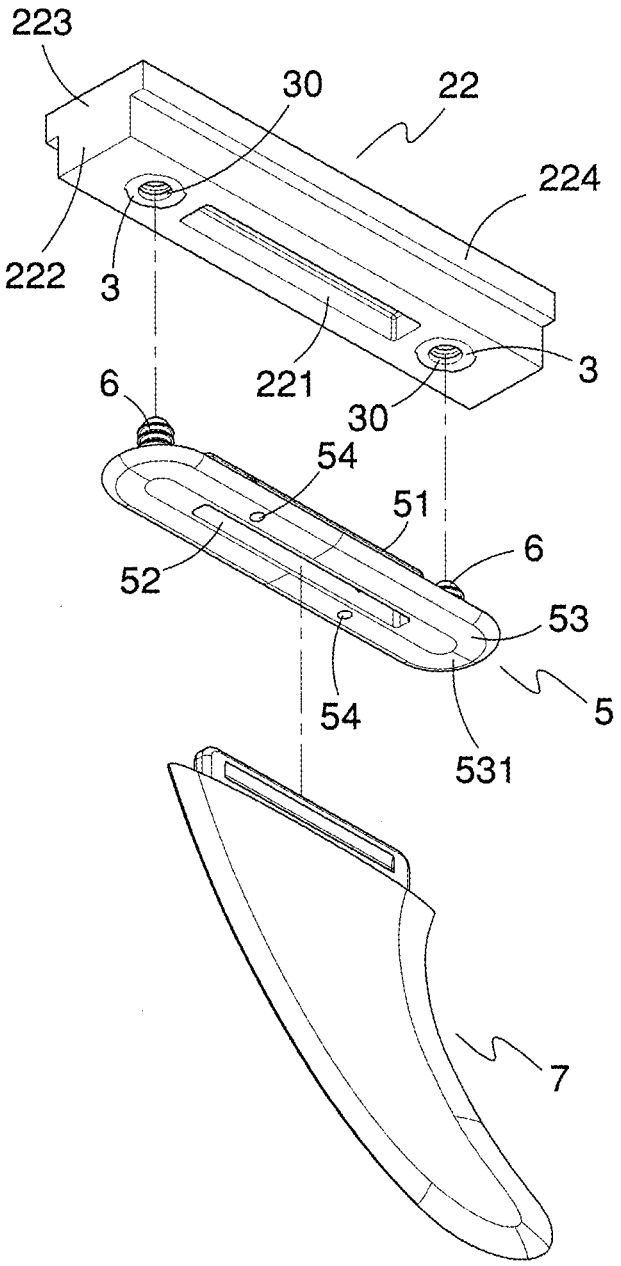
FIG. 3 is a partial exploded perspective view of the watersport board shown in FIG. 1.
Figure 4:
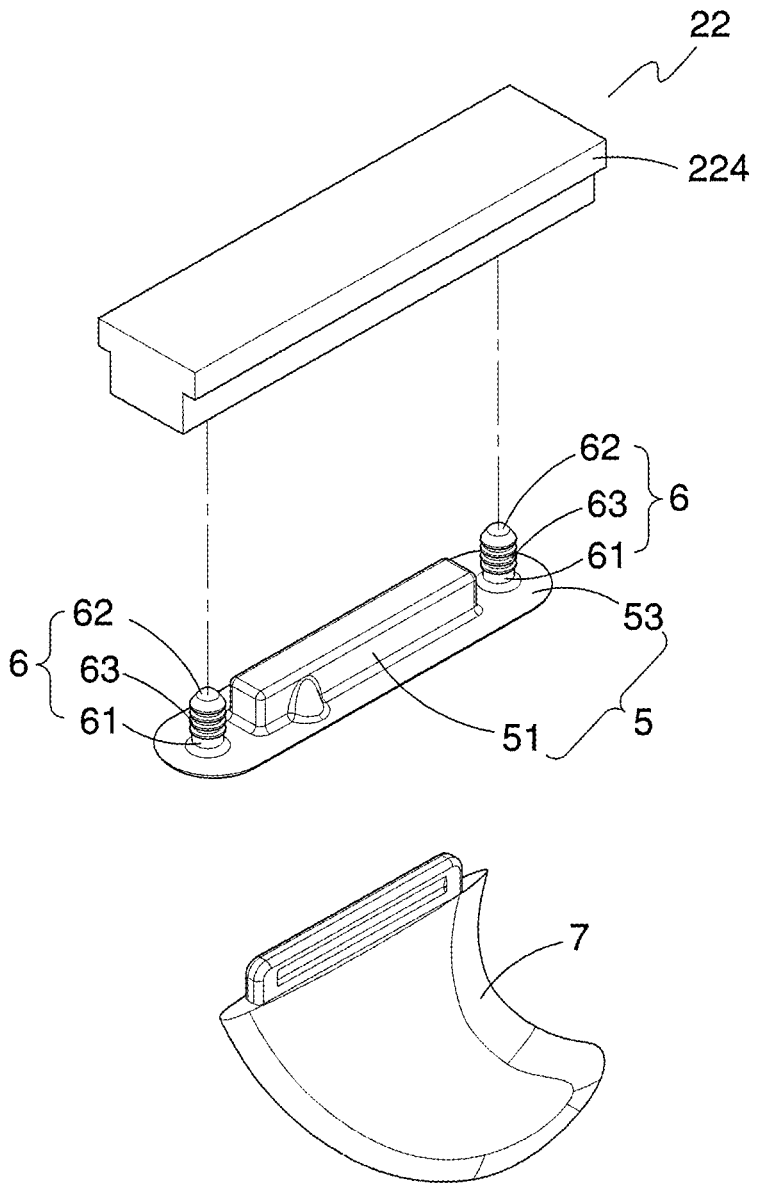
FIG. 4 is another partial enlarged cross-sectional view of the watersport board shown in FIG. 1, taken from another angle.

As shown in FIGS. 2-4, the board body 2 includes a foam core 21 and a connection block 22 embedded in the bottom surface 211 of the foam core 21 and exposed to outside of the foam core 21. The connection block 22 has a receptacle 221 defined therein. The foam core 21 is made of a first foam material, and the connection block 22 is made of a second foam material which is tougher than the first foam material. In this embodiment, the first foam material is expanded polystyrene (EPS) while the second foam material is a copolymer of expanded polystyrene (EPS) and expanded polyethylene (EPE). In this way, the tough connection block 22 may serve as a buffer, protecting the foam core 21 from damage, when the connected fin 7 is subjected to a load or force.

The two female fasteners 3 are made of non-foam plastic and embedded in the bottom surface 222 of the connection block 22. Each of the female fasteners 3 has a receiving hole 30 exposed in the bottom surface 211 of the foam core 21.

Figure 6:
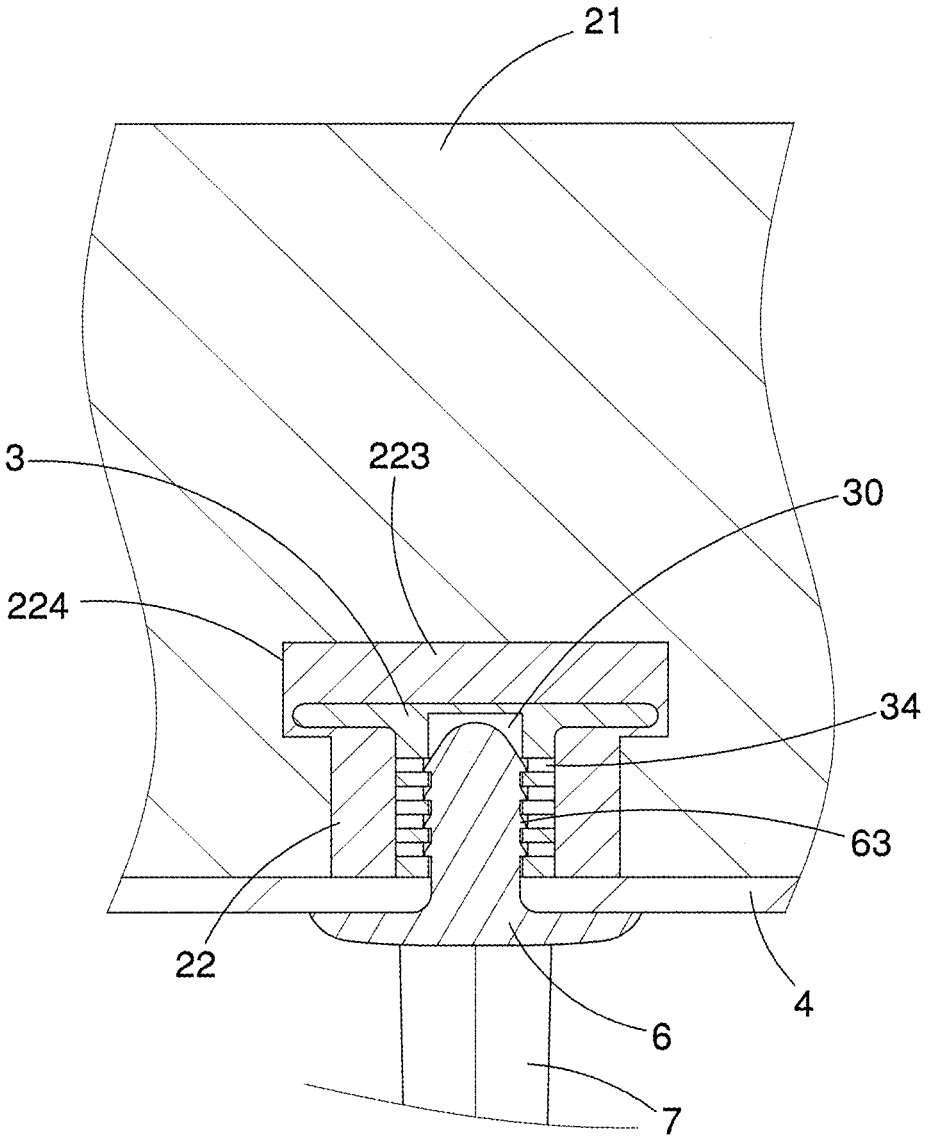
FIG. 6 is a partial cross-sectional view of the watersport board shown in FIG. 1, taken from another angle.

In this embodiment, the foam core 21, the connection block 22 and the female fasteners 3 are bonded together through the following process: Firstly, the female fasteners are positioned in a mold and a plurality of pre-expanded foam beads for making the connection block 22 are poured into the mold. The mold is then heated to have the pre-expanded foam beads be transformed into an expanded connection block 22 in a shape of the mold cavity with the two female fasteners 3 embedded in the connection block 22. Preferably, adhesives may be applied onto the exterior surfaces of the female fasteners 3, before the foaming process, to enhance the bonding strength between the female fasteners 3 and the connection block 22. The connection block 22 together with the embedded female fasteners 3 is then bonded to the foam core 21 through a similar foaming process. Preferably, adhesives may be applied onto the exterior surfaces of the connection block 22, before the foaming process, to enhance the bonding strength between the connection block 22 and the foam core 21. In particular, as shown in FIGS. 4 and 6, the connection block 22 is shaped to include a protrusion 224 laterally extending from an upper edge thereof to prevent the connection block 22 from falling off the foam core 21.

Referring to FIG. 2, the baseplate 4 is attached to the bottom surface 211 of the foam core 21 as well as the bottom surface 222 of the connection block 22. Moreover, the baseplate 4 has a first bore 41 in line with the receptacle 221 of the connection block 22 and a plurality of second bores 42 in line with the receiving holes 30 of the female fasteners 3. Preferably, the baseplate 4 is made of non-foam plastic, such as low-density polyethylene (LDPE), medium-density polyethylene (MDPE) or high-density polyethylene (HDPE).

Referring to FIGS. 2-4, the fin adapter 5 includes an adapter body 51 and an extension 53 laterally extending from a lower edge of the adapter body 51. The adapter body 51 passes through the first bore 41 of the baseplate 4 and is engaged in the receptacle 221 of the connection block 22. The adapter body 51 has a cavity 52 defined in a bottom surface thereof. The fin 7 has a base portion 70 received in the cavity 52 of the adapter body 51 of the fin adapter 5. Moreover, the adapter body 51 further has two fixing holes 54 staggered from one another. Each fixing hole 54 extends in a slanted direction from a bottom surface 531 of the extension 53 to an inner wall of the cavity 52. As such, bolts (not shown) may be employed and inserted into the two fixing holes 54 to secure the fin 7 into the cavity 52 of the adapter body 51 of the fin adapter 5.

Each of the male fasteners 6 has one end 61 connected to the extension 53 of the fin adapter 5, and the other end 62 passing through the second bore 42 of the baseplate 4 and engaged in the respective receiving hole 30 of the female fastener 3 so as to secure the fin adapter 5 in the receptacle 221 of the connection block 22. In this embodiment, the male fasteners 6 are integrally formed with the extension 53 of the fin adapter 5. And, as shown in FIG. 4, each of the male fasteners 6 has a plurality of axially spaced annular barb rings 63 formed on an exterior surface thereof.

Figure 5:
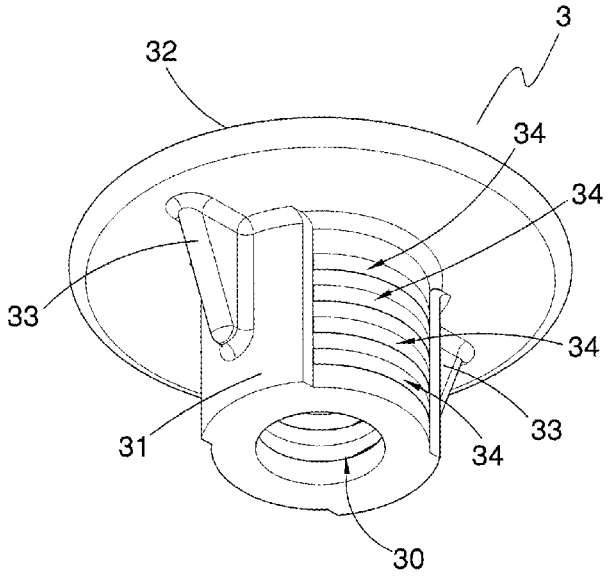
FIG. 5 is a perspective view of a female fastener of the watersport board shown in FIG. 1.

Referring to FIG. 5, each of the female fasteners 3 includes a barrel 31 in which the receiving hole 30 is defined, a head 32 integrally formed on an upper end of the barrel 31, and a pair of ribs 33 laterally joined between the barrel 31 and the head 32. Moreover, each of the female fasteners 3 further has a plurality of locking orifices 34 defined in opposed walls of the receiving hole 30 of the barrel 31. The barb rings 63 of each male fastener 6 are engaged in the respective locking orifices 34 of the female fastener 3 to inhibit removal of the fin adapter 5 from the female fasteners 3. Preferably, the female fasteners 3 is made of non-foam plastic, such as low-density polyethylene (LDPE), medium-density polyethylene (MDPE) or high-density polyethylene (HDPE).

Figure 7:
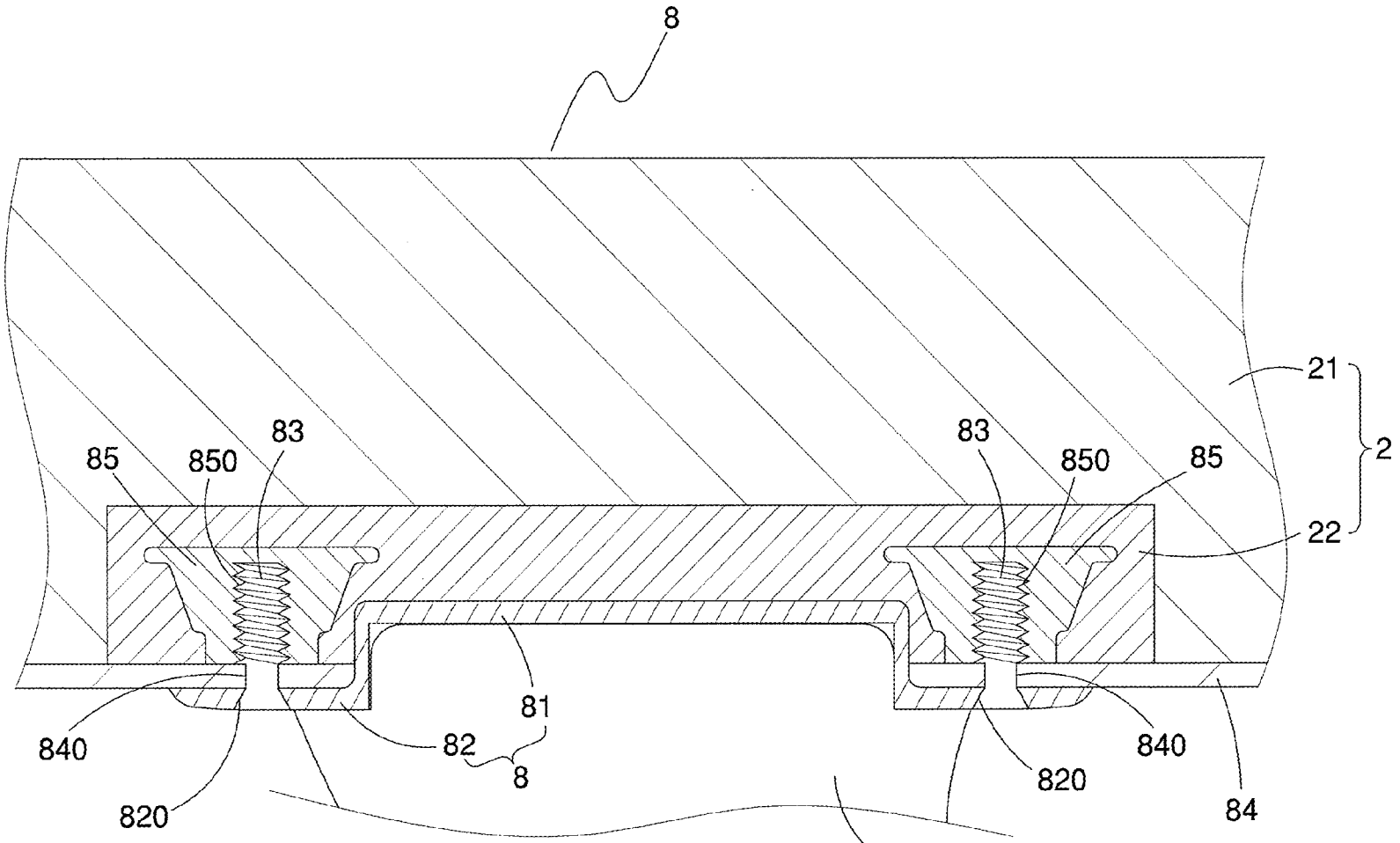
FIG. 7 is a partial cross-sectional view of a watersport board in accordance with another embodiment of the present invention.
Figure 8:
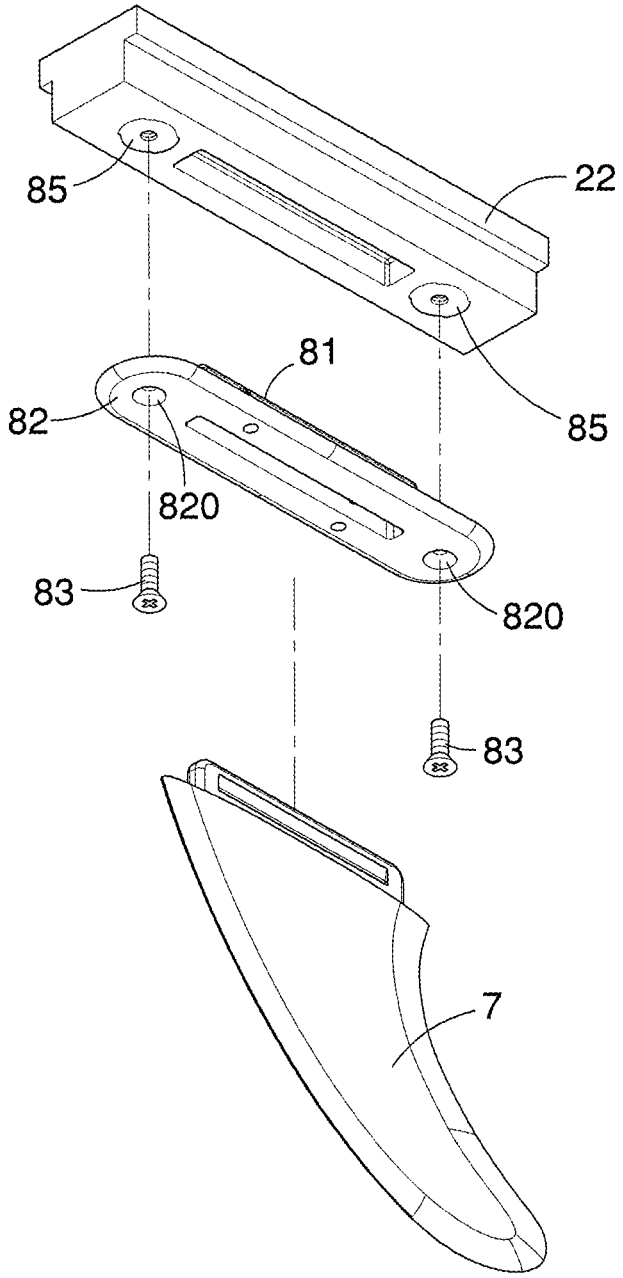
FIG. 8 is a partial cross-sectional view of the watersport board shown in FIG. 7.
Figure 9:
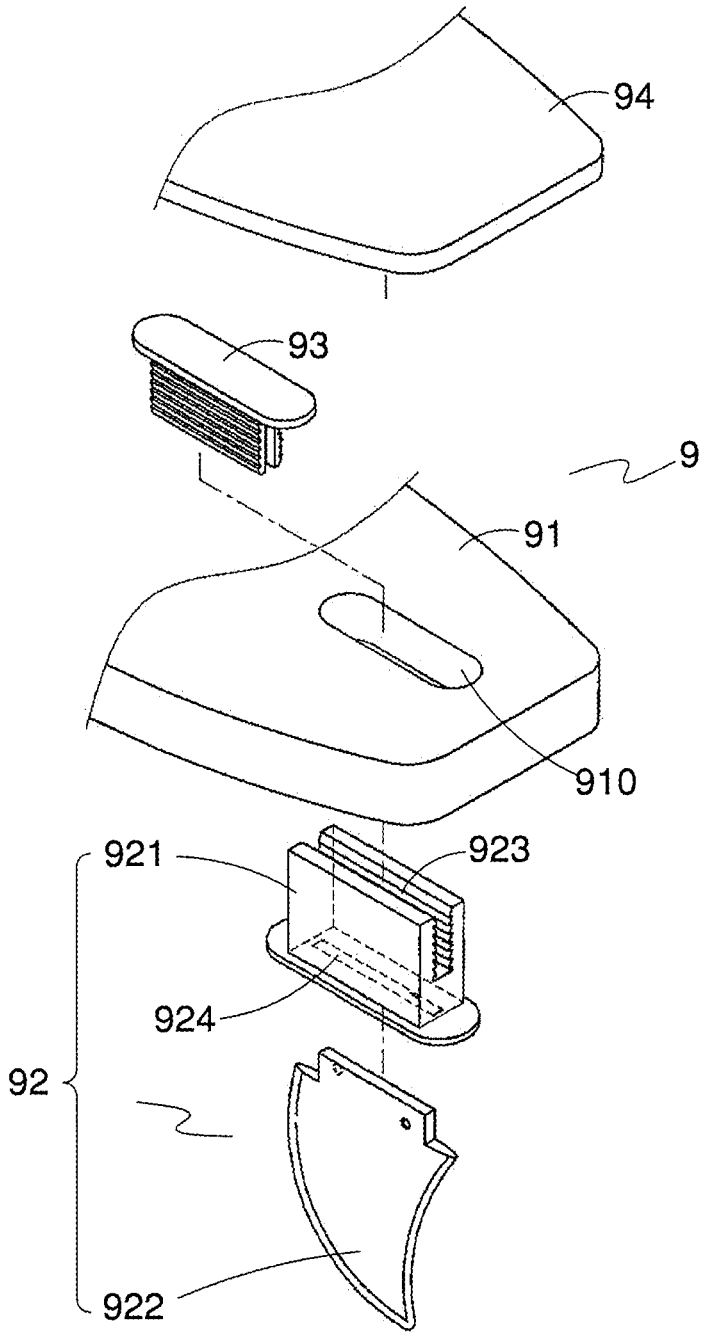
FIG. 9 (Prior Art)
FIG. 9 is a prior art.

With reference to FIGS. 7 and 8, a watersport board 8 is provided according to another embodiment of the present invention. The watersport board 8 of this embodiment is substantially identical to that of the aforementioned embodiment, except that the male fasteners 83 are no longer integrally formed with the extension 82 of the fin adapter 81, but is formed in a single piece assembled to the extension 82 of the fin adapter 81. More specifically, the extension 82 of fin adapter 81 defines two through holes 820. The two male fasteners 83 pass through the two through holes 820 of the extension 82 of the fin adapter 81, the second bores 840 of the baseplate 84 and into the receiving holes 850 of the female fasteners 85 so as to fasten the fin adapter 81 and the female fasteners 85 together.

It should be evident that this disclosure is by way of example and that various changes may be made by adding, modifying or eliminating details without departing from the fair scope of the teaching contained in this disclosure.

What is claimed is:

1. A watersport board comprising:

a board body defining a receptacle in a bottom surface;

a plurality of female fasteners embedded in the bottom surface of the board body, each of the female fasteners having a receiving hole exposed to outside of the board body;

a baseplate attached to the bottom surface of the board body and defining a first bore in line with the receptacle of the board body and a plurality of second bores in line with the respective receiving holes of the female fasteners;

a fin adapter having an adapter body and an extension laterally extending from a lower edge of the adapter body, wherein the adapter body passes through the first bore of the baseplate and is engaged in the receptacle of the board body, and the adapter body has a cavity defined in a bottom surface thereof;

a fin having a base portion received in the cavity of the adapter body of the fin adapter; and a plurality of male fasteners each having one end connected to the extension of the fin adapter, and the other end passing through the second bore of the baseplate and being engaged in the respective receiving hole of the female fastener so as to secure the fin adapter in the receptacle of the board body;

wherein each of the female fasteners further has a plurality of locking orifices defined in opposed walls of the receiving hole of the female fastener; and each of the male fasteners has a plurality of axially spaced annular barb rings formed on an exterior surface thereof and engaged in the respective locking orifices of the female fastener to inhibit removal of the fin adapter from the female fasteners.

2. A watersport board as recited in claim 1, wherein the board body includes a foam core and a connection block embedded in the foam core; the foam core comprises a first foam material, and the connection block comprises a second foam material which is different from the first foam material; the baseplate is bonded to the connection block; the receptacle of the board body is defined in the connection block, and the female fasteners are embedded in the connection block.

3. A watersport board as recited in claim 2, wherein the first foam material is expanded polystyrene while the second foam material is a copolymer of expanded polystyrene and expanded polyethylene.

4. A watersport board as recited in claim 3, wherein the female fasteners comprise non-foam plastic and is secured to the connection block with adhesive.

5. A watersport board as recited in claim 3, wherein the baseplate comprises a material of non-foam polyethylene.

6. A watersport board as recited in claim 2, wherein the connection block has a protrusion laterally extending from an upper edge thereof to prevent the connection block from falling off the foam core.

7. A watersport board as recited in claim 1, wherein the male fasteners are integrally formed with the extension of the fin adapter.

8. A watersport board as recited in claim 1, wherein the extension of the fin adapter defines a plurality of through holes; and the male fasteners pass through the respective through holes of the extension of the fin adapter and the second bores of the baseplate and into the respective receiving holes of the female fasteners so as to fasten the fin adapter and the female fasteners together.

9. A watersport board as recited in claim 1, wherein each of the female fasteners includes a barrel in which the receiving hole is defined, a head integrally formed on an upper end of the barrel, and a plurality of ribs joined between the barrel and the head.

* * * * *